US005601222A

United States Patent [19]

Haddad

[11] Patent Number: 5,601,222

[45] Date of Patent: Feb. 11, 1997

[54] MAGNIFYING WRISTBAND

[76] Inventor: Richard Y. Haddad, 2315 Morrow Rd., Pittsburgh, Pa. 15241

[21] Appl. No.: 450,088

[22] Filed: May 25, 1995

[51] Int. Cl.[6] ..... A44C 5/00

[52] U.S. Cl. ..... 224/165; 224/219; 368/282; 368/10; 63/21; 359/810; 359/815

[58] Field of Search ..... 224/165, 173, 224/219, 222; 359/809, 810, 815; 368/281, 282, 10; 63/21

[56] References Cited

U.S. PATENT DOCUMENTS

| | | | |
|---|---|---|---|
| D. 206,684 | 1/1967 | Bevilacqua | 359/815 |
| 1,874,984 | 11/1931 | Hanskat . | |
| 2,679,785 | 6/1954 | Batt | 359/809 |
| 3,470,638 | 10/1969 | Friedman et al. | 40/107 |
| 3,521,798 | 7/1970 | Hill | 224/4 |
| 3,585,744 | 6/1971 | Arnone | 40/21 |
| 3,780,918 | 12/1973 | Curtis | 224/165 |
| 3,864,856 | 2/1975 | McManus | 40/21 |
| 3,924,304 | 12/1975 | Grandmont | 224/165 |
| 3,971,206 | 7/1976 | Martino | 224/165 |
| 4,083,136 | 4/1978 | Zelenko | 40/518 |
| 4,779,249 | 10/1988 | Rapport | 368/276 |
| 5,081,852 | 1/1992 | Cox | 63/3 |
| 5,183,193 | 2/1993 | Brandell | 224/219 |
| 5,259,540 | 11/1993 | Kocznar et al. | 224/219 |
| 5,333,907 | 8/1994 | Schaeffer | 359/809 |

FOREIGN PATENT DOCUMENTS

| | | | |
|---|---|---|---|
| 456062 | 2/1928 | Germany . | |
| 2067386 | 7/1981 | United Kingdom | 224/165 |

*Primary Examiner*—Henry J. Recla
*Assistant Examiner*—Charles R. Eloshway
*Attorney, Agent, or Firm*—Webb Ziesenheim Bruening Logsdon Orkin & Hanson, P.C.

[57] ABSTRACT

A wristband adapted to secure a display element having a display face, such as a wristwatch, calculator or the like, to the user's wrist includes a flexible, or shaped nonflexible, transparent magnification strip. The magnification strip is adapted to be positioned over the display face of the display element. In this manner, the user can magnify the display for easier viewing.

10 Claims, 2 Drawing Sheets

MAGNIFYING WRISTBAND

BACKGROUND OF THE INVENTION

1. Field of the Invention

The present invention relates to a wristband adapted to secure a display element, such as a wristwatch. More specifically, the present invention is directed toward a wristband having a magnification device coupled to it which is adapted to be positioned over the top face of the display element.

2. Background Information

Wrist-held display elements, such as watches, calculators and the like, often present tiny displays which are difficult to read with the naked eye. This is particularly true where these devices have a relatively small digital readout, such as a liquid crystal display.

The objects of the present invention are to overcome this drawback of the prior art and provide a wristband for carrying a display element on the wrist of the user which further allows the user to magnify the display.

SUMMARY OF THE INVENTION

The objects of the present invention are achieved by providing a wristband which is adapted to secure a display element, such as a watch, to a user's wrist. Other types of data which may be displayed, individually or collectively, upon the display element include altitude, temperature, elapsed time, call back numbers and calculated data, for example. The wristband of the present invention includes a band connected to the display element which may, at least partially, embrace or encircle the user's wrist. A transparent magnification strip is connected to the band so that the magnification strip may be positioned over the display face of the display element to magnify the indicia on the display face.

In one embodiment of the present invention, a first strap is connected at one end to the display element and includes a series of spaced holes adjacent the free end for engaging the finger of a buckle. A flexible or shaped nonflexible magnification strip is embedded within a portion of the first strap between the display element and the holes. A second strap is connected at one end to the opposite side of the display element and has a buckle at the free end. This embodiment provides for ease of manufacture since the wristband can be formed in the conventional fashion to conventional dimensions with the only addition being the insertion or the embedding of the magnification strip within the first strap. In operation, the user can detach the first strap from the buckle and position the magnification strip over the display face of the display element as needed. In an alternate version of this embodiment, the magnification strip is embedded in the second strap between the display element and the buckle. Also, in place of a series of holes on one strap and a buckle on the other, the one strap may be provided with a clasp that grips the other strap. Still other connectors can be used in place of the buckle and clasp.

In a second embodiment of the present invention, the first strap is connected at one end thereof to the display element and includes a series of spaced buckle-engaging holes. A second strap is connected at one end thereof to an opposed side of the display element and has a buckle at an opposite end thereof which is adapted to engage the buckle-engaging holes of the first strap. The magnification strip is embedded within the first strap at a position closer to the free end than the buckle-engaging holes. This embodiment provides a first strap which is longer than needed for securing the wristband to the user's wrist. This configuration provides the possibility of having the magnification strip positioned over the display face of the display element while the wristband and display element are secured to the user's wrist.

A further embodiment of the present invention provides a third strap attached at one end thereof to the first (or second) strap with the magnification strip embedded within the third strap. This arrangement provides the advantage of having the third strap optionally positioned over the top face of the display element while the wristband is on the user's wrist.

A further embodiment of the present invention provides the magnification strip attached to one end of the first strap and may include a series of spaced buckle-engaging holes in the magnification strip itself for engaging with a buckle of a second strap.

In a still further embodiment, the wristband is of the expansion type (no buckle) and the magnification strip is held within a frame secured at one end to the expansion band so that in normal use the magnification strip lays over a portion of the expansion band biased thereagainst. When the magnification strip is required, by pulling out the expansion band, the magnification strip can be positioned over the top face of the display element without the need to remove the wristband from the wrist.

BRIEF DESCRIPTION OF THE DRAWINGS

Further features and other objects and advantages of this invention will become clear from the following detailed description made with reference to the drawings in which.

DESCRIPTION OF THE PREFERRED EMBODIMENTS

Figure 1:
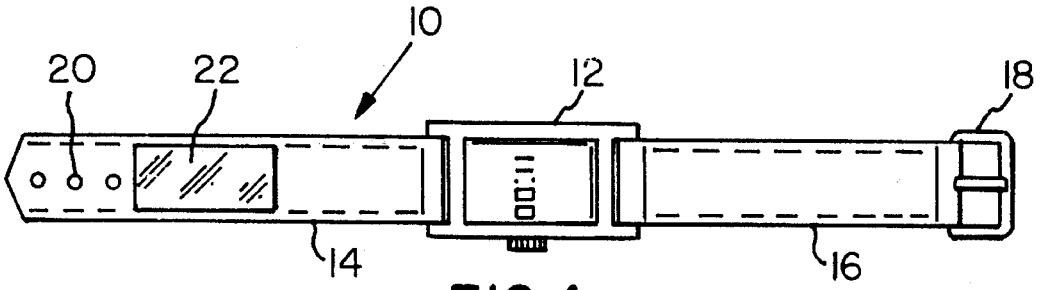
FIG. 1 is a plan view of a wristband according to a first embodiment of the present invention.

FIG. 1 illustrates a wristband 10 according to a first embodiment of the present invention. The wristband 10 is connected to a watch 12. The watch 12 has a body and a display face for displaying the time and/or other data. It should be understood that the wristband 10 could also be used with a calculator or other wrist-held object.

A wrist strap 14 is connected at one end to one side of the watch 12 in a conventional fashion, for example, by a pin secured in the body of the watch 12 extending through a loop positioned at one end of the wrist strap 14. A wrist strap 16 is connected at one end to an opposite side of the watch 12 in a similar manner as the wrist strap 14. The wrist strap 16 includes a buckle 18 at an opposed end thereof. The buckle 18 will optionally engage one of a plurality of spaced buckle-engaging holes 20 provided on the first wrist strap 14. The wristband 10 can secure the watch 12 to the user's wrist by having the wrist straps 14 and 16 encircle the user's wrist with the buckle 18 engaging an appropriate one of the buckle-engaging holes 20 in a conventional fashion.

The wrist strap 14 includes a flexible, or shaped nonflexible, transparent magnification strip 22 embedded therein at a position between the plurality of buckle-engaging holes 20 and the one end of the wrist strap 14 which is secured to the watch 12.

Where the band is comprised of flexible straps, the magnification strip 22 is preferably formed of a flat sheet of flexible plastic material, generally acrylic material, provided with a plurality of ridges or grooves therein which extend outwardly from the center of the lens in a generally concentric pattern, thereby forming a Fresnel lens. Similar materials are the SIGHT SAVERS® brand magnifying sheets known as Magna-Thin® and Magna-Page™ magnifiers which are manufactured by BAUSCH & LOMB. The flexibility of the magnification strip 22 allows it to be utilized in the wristband 10. However, a shaped nonflexible transparent magnification strip may be used and may be preferable where the band is of the expandable type.

Figure 2:
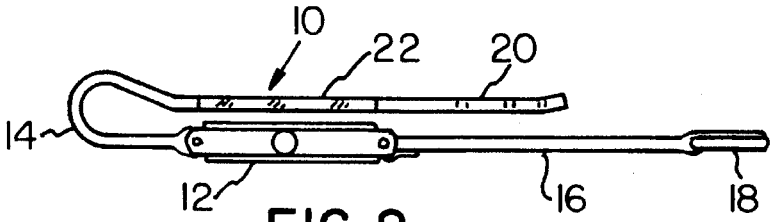
FIG. 2 is a side view of the wristband illustrated in FIG. 1 with the magnification element illustrated in an operative position.

FIG. 2 illustrates the wristband 10 of the present invention with the magnification strip 22 in the use position over the display face of the watch 12. In this manner, the user can selectively utilize the magnification strip 22, as needed, to amplify the display of the display element 12 for easier viewing. The user can increase the magnification by bending the magnification strip 22. Additionally, the design of the wristband 10 allows the wrist straps 14 and 16 to be made in a substantially conventional fashion with the only additional step being that of cutting out an appropriate portion of the wrist strap 14 for insertion and attachment of the magnification strip 22. The magnification strip 22 may be secured by stitching, adhesives or other equivalent means. This design also allows for the retrofitting of existing wristbands.

Figure 3:
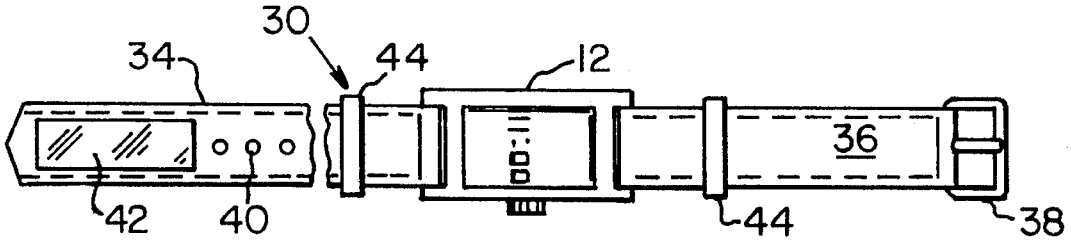
FIG. 3 is a top plan view of a wristband according to a second embodiment of the present invention.
Figure 4:
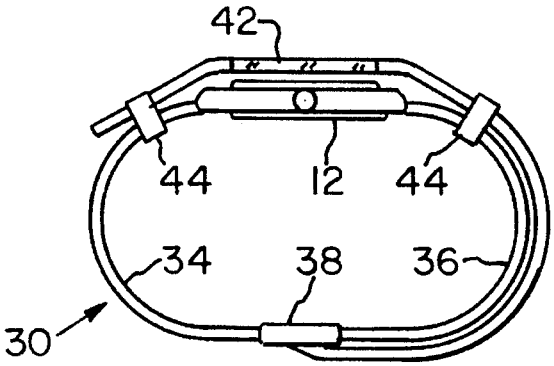
FIG. 4 is a side view of the wristband illustrated in FIG. 3 with the magnification element illustrated in an operative position.

Wristband 30, illustrated in FIGS. 3 and 4, is similar to the wristband 10, illustrated in FIGS. 1 and 2, and includes watch 12 coupled to wrist straps 34 and 36 in the same manner described above in connection with FIGS. 1 and 2. The wristband 30 additionally includes buckle 38, a series of spaced buckle-engaging holes 40 in the wrist strap 34 and the rectangular, flexible, transparent magnification strip 42 embedded within the wrist strap 34. The embodiment disclosed in FIGS. 3 and 4 differs from the embodiment disclosed in FIGS. 1 and 2 in that the magnification strip 42 is positioned on the opposite side of the series of buckle-engaging holes 40 so that it is farther from the end of the watch strap 34 which is connected to the watch 12 than the buckle-engaging holes 40. This positioning would require that the wrist strap 34 is longer than the wrist strap 14 illustrated in the embodiment shown in FIGS. 1 and 2. As illustrated in FIG. 4, this configuration allows the magnification strip 42 to be positioned over the display face of the watch 12 while the wristband 30 is on the user's wrist. It is advantageous to be able to utilize the magnification strip 42 while the wristband 30 is on the user's wrist. If the magnification of the magnification strip 42 is not desired, the wrist strap 34 can be folded over on itself so as not to overlay the watch 12. The embodiment disclosed in FIGS. 3 and 4 also illustrates strap-holding loops 44 on both the wrist strap 34 and the wrist strap 36. The strap-holding loops 44 can be utilized, as illustrated in FIG. 4, to secure the wrist strap 34 in position after the buckle 38 has engaged the appropriate buckle-engaging holes 40. The loops 44 can also be utilized in the embodiment illustrated in FIGS. 1 and 2 with the loops 44 operating in their conventional fashion.

Figure 5:
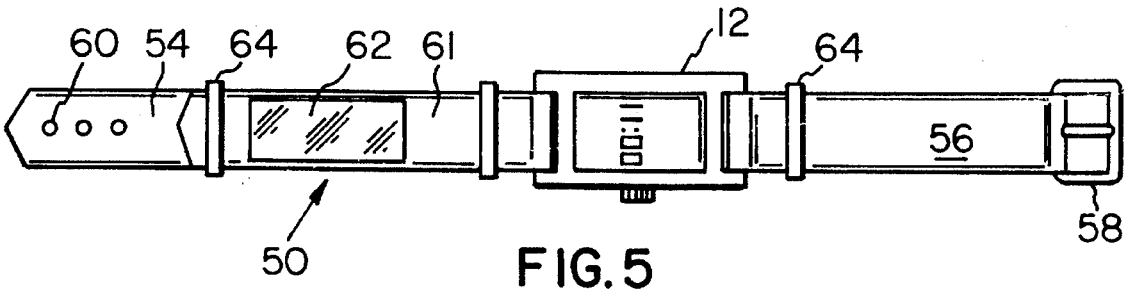
FIG. 5 is a plan view of a wristband according to a third embodiment of the present invention.
Figure 6:
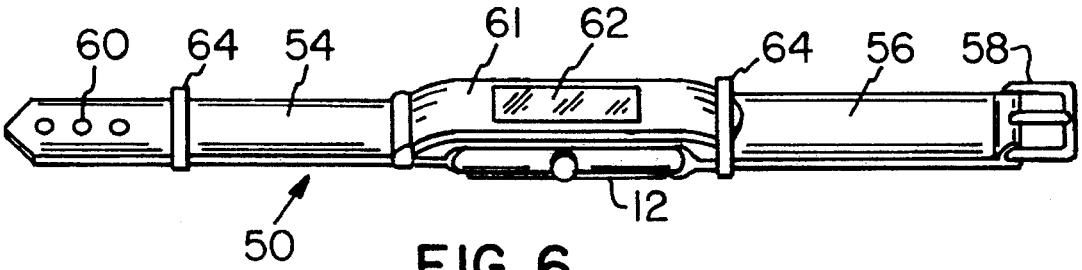
FIG. 6 is a perspective view of the wristband illustrated in FIG. 5 with the magnification element in an operative position.

FIGS. 5 and 6 illustrate a wristband 50 similar to the wristbands 10 and 30 disclosed above. The wristband 50 includes wrist straps 54 and 56 coupled to the watch 12 and buckle 58 and buckle-engaging holes 60 which are substantially similar to the elements discussed above. The embodiment illustrated by FIGS. 5 and 6 differs from the previous embodiments by providing an additional or third strap 61 pivotally secured to the wrist strap 54 at a position substantially adjacent the end of the wrist strap 54 which is attached to the watch 12. A magnification strip 62 is embedded within the third strap 61. As shown in FIG. 6, the third strap 61 can be positioned such that the magnification strip 62 is over the display face of the watch 12 to provide the appropriate magnification. Loops 64 can be provided on each of the wrist straps 54 and 56 into the appropriate position to secure the third strap 61 into either a stowed position, as illustrated in FIG. 5, or the viewing position, as illustrated in FIG. 6. The embodiment disclosed in FIGS. 5 and 6 provides the advantage of allowing the user to optionally utilize the magnification properties of the magnification strip 62, as needed, without removing the wristband 50 from the user's wrist. Additionally, the embodiment disclosed in FIGS. 5 and 6 provides for easy assembly of the present invention utilizing existing wristbands since the embodiment only requires the attachment of the third strap 61 to the wrist strap 54 with the appropriate addition of loops 64 or equivalent attaching means to each of the wristbands.

Figure 7:
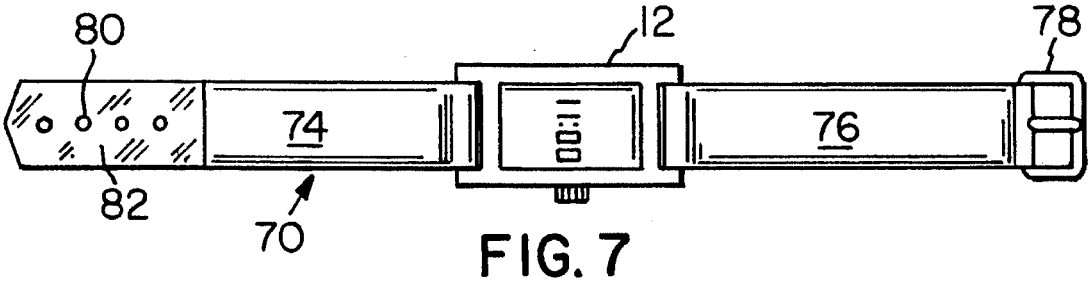
FIG. 7 is a plan view of a third embodiment of the wristband according to the present invention.

FIG. 7 illustrates a wristband 70 according to a fourth embodiment of the present invention. This embodiment includes wrist straps 74 and 76 attached to the watch 12 in the manner described above. In this embodiment, a magnification strip 82 is attached to the free end of the wrist strap 74 with a plurality of buckle-engaging holes 80 being formed in the magnification strip 82 itself to engage with a buckle 78 of the wrist strap 76. The wristband 70 can be utilized in substantially the same manner as described above in connection with the wristband 10. The magnification strip 82 may be positioned over the display face of the watch 12 when the magnification properties thereof are required.

Figure 8:
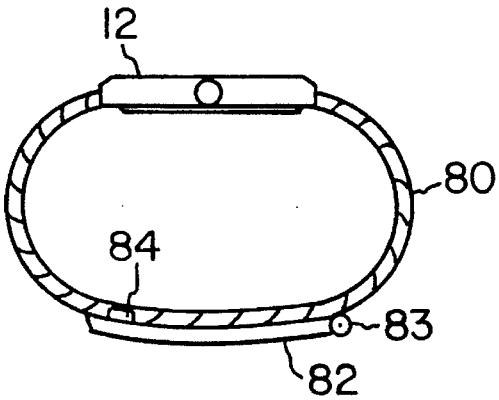
FIG. 8 is a side view of a fourth embodiment of this invention comprising an expandable wristband.

Referring now to FIG. 8, there is illustrated a watch or multi-function time piece 12 secured to an expansion band 80 that is an expandable link-type band. Arranged to lay along of the bottom of the expansion band is a shaped nonflexible lens held in a frame 82. The frame 82 is pivotally connected to one link of the band by a hinge 83. Opposite the hinge, a catch 84 is attached to the frame 82 and snaps over the expansion band to hold the lens in place. When the lens is required to read the watch 12, the lens is unsnapped from the band and the band is flexed to pull the lens over the face of the watch.

Having thus described my invention with the detail and particularity required by the Patent Laws, what is claimed to be protected by Letters Patent is set forth in the following claims.

I claim:

1. A wristband adapted to secure a device having a display face to a user's wrist, said wristband comprising:

a band adapted to be connected to the device and adapted to at least partially embrace the user's wrist; and a transparent magnification strip fixedly embedded within said band, said band and magnification strip having a stowed position and said band being movable to a position with the magnification strip over the display face.

2. The wristband of claim 1 wherein said band comprises first and second straps, said straps each connectable at one end thereof to the device and each having a connector at an opposite end for releasably attaching said first and second straps together, and the magnification strip being flexible and embedded in one of said first and second straps.

3. The wristband of claim 2 wherein said second strap includes a series of spaced buckle-engaging holes adjacent said opposite end thereof, said magnification strip embedded within said second strap between said opposite end thereof and said buckle-engaging holes.

4. The wristband of claim 2 wherein said second strap is adapted to be connected at one end thereof to the device and includes a series of spaced buckle-engaging holes therein which are positioned closer to said opposite end of said second strap than said magnification strip.

5. The wristband of claim 1 wherein said magnification strip is adapted to be positioned over the display face of the device while said wristband is on the user's wrist.

6. The wristband of claim 1, said band further including an overlay strap, wherein said magnification strip is embedded within said overlay strap and wherein said overlay strap is movable to be positioned above the display face while said wristband is on the user's wrist.

7. The wristband of claim 6 further including means on said band for securing a free end of said overlay strap in a stowed position.

8. The wristband of claim 1 wherein said magnification strip further includes a plurality of spaced holes therein.

9. The wristband of any one of claims 1 to 8 wherein said magnification strip is a transparent plastic material having a plurality of grooves formed therein to provide magnification properties thereto.

10. The watch band of claims 1, 5, 6, 7 or 8 wherein said magnification strip is a shaped nonflexible transparent lens.

* * * * *